US005711194A

United States Patent [19]

Anderson et al.

[11] Patent Number: 5,711,194

[45] Date of Patent: Jan. 27, 1998

[54] FOLDING KNIFE AND INTERCHANGEABLE BIT SCREWDRIVER

[76] Inventors: Wayne Anderson; Paolo Cassutti, both of 171 Brook Ave., Deer Park, N.Y. 11729

[21] Appl. No.: 451,398

[22] Filed: May 26, 1995

[51] Int. Cl.[6] ..... B25B 23/00

[52] U.S. Cl. ..... 81/440; 81/439; 7/118; 7/165

[58] Field of Search ..... 7/118, 165, 168; 81/437–439, 440; 30/123, 151, 164, 155, 161

[56] References Cited

U.S. PATENT DOCUMENTS

| | | | |
|---|---|---|---|
| 1,226,636 | 5/1917 | Brown | 7/118 |
| 1,787,424 | 1/1931 | Altenbach | 7/118 X |
| 3,364,508 | 1/1968 | Garrett | 7/118 |
| 4,448,097 | 5/1984 | Rocca | 81/439 X |
| 4,730,394 | 3/1988 | Sonner, Jr. | 30/161 |
| 4,815,346 | 3/1989 | Littlehorn | 81/439 |
| 4,848,197 | 7/1989 | Kikel | 81/438 X |

*Primary Examiner*—D. S. Meislin

*Attorney, Agent, or Firm*—Lackenbach Siegel Marzullo, Aronson & Greenspan

[57] ABSTRACT

Folding pocket-style knife and screwdriver having interchangeable bits in which a hinged sleeve folds integrally into the knife handle and unfolds to and locks in 90 and 180 degree angles with the handle to provide angled and straight screwdrivers. The sleeve is a retainer for interchangeable screwdriver bits, retained by ball, C-clip or magnetic retainers.

7 Claims, 5 Drawing Sheets

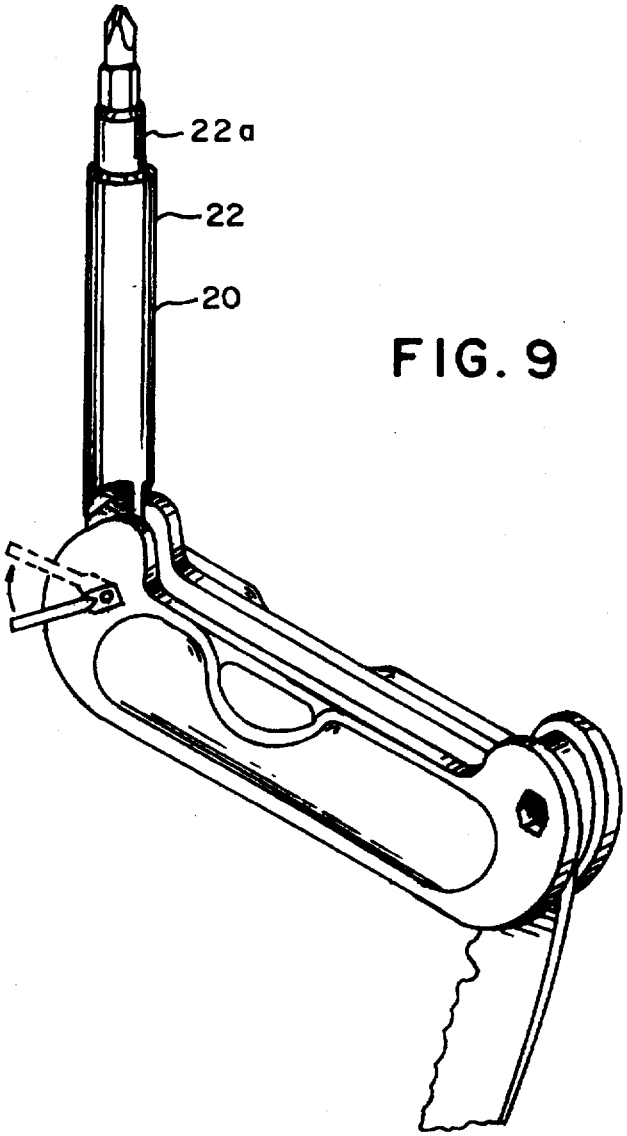
FIG. 9
FIG. 10
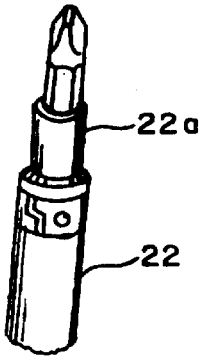
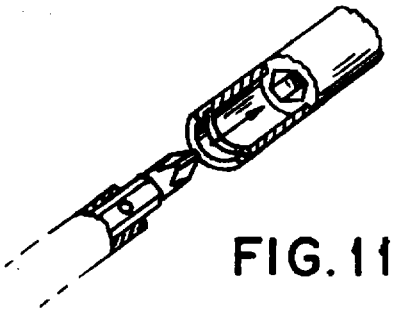
FIG. 11

FIG.12
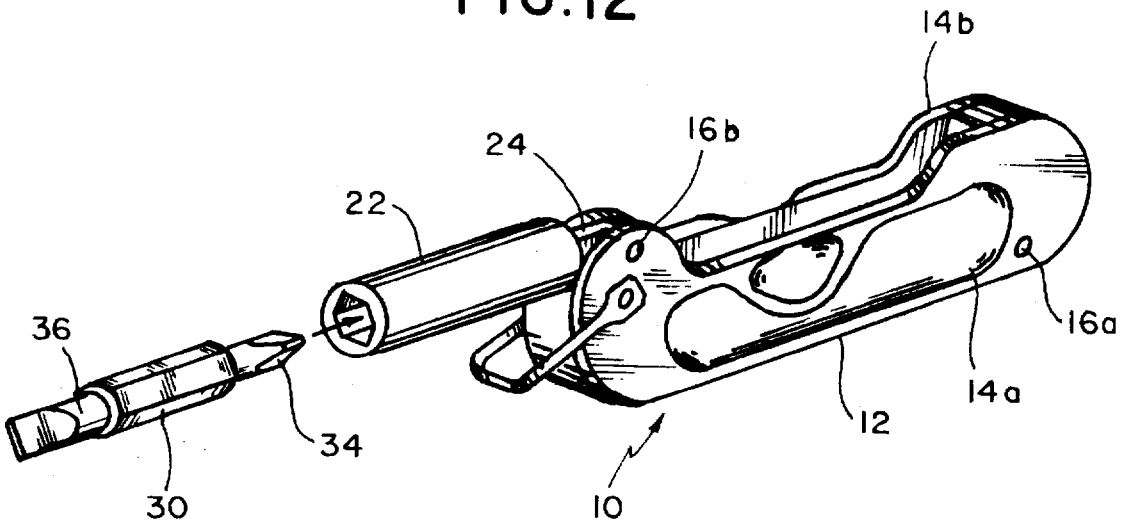
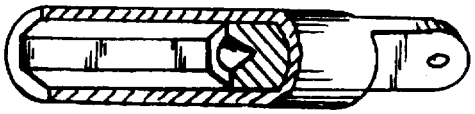
FIG.13

FOLDING KNIFE AND INTERCHANGEABLE BIT SCREWDRIVER

BACKGROUND OF THE INVENTION

Incorporation of multiple tool functions or abilities into a single tool device is a well-known convenience as is incorporation of multiple blades and tools which "fold" into a handle in conventional pocket knife configuration. Such blades and tools do not themselves generally fold, but are hinged to the handle and the combination blade and handle are said to fold closed for safe and convenient transport and unfold, or hinge open, for use. In such conventional pocket knife configurations as are known to the applicant, each blade and tool function is represented by a single operative member, such as a knife blade or a screwdriver blade, which are combined in some stacked arrangement to hinge with respect to the handle. On the other hand, multi-purpose tools are known which do not fold, such as interchangeable-bit screwdrivers.

SUMMARY OF THE INVENTION

The present invention provides folding pocket-type knives with the flexibility and functionality of multi-purpose tools. The present invention provides a folding combination pocket-type knife with the professional usefulness of interchangeable-bit screwdrivers and offset screwdrivers using the same interchangeable bit.

In particular, the present invention provides hinged sleeve means which removably retains screwdriver bits in hinged relationship to a handle adapted to receive the sleeve and bit in recessed storage relationship and in exposed functioning relationship. The sleeve means has retaining means which cooperates with the bit to removably secure the bit in the sleeve. The double ended bit is interchangeable with other bits and is reversible, having a different drive at each end.

Also provided is hexagonal cross-hole, extending from one side bolster to the other of the handle, to receive the interchangeable bits in perpendicular relation to the handle, creating an offset interchangeable bit section of the invention. Retractable ball retaining means on each interchangeable bit retains the offset bit by fitting between the side bolsters and being retained thereby.

The folding blades may have provision for locking in open positions for safety to prevent the blades from unexpectedly snapping closed.

DESCRIPTION OF THE DRAWING

In the drawing:

FIG. 9 is a perspective view of the folding knife and interchangeable bit screwdriver of the invention shown in FIG. 6.

FIG. 10 is a fragmentary perspective view of the sleeve-in-sleeve and bit of the folding knife and interchangeable bit screwdriver of the invention.

FIG. 11 is a fragmentary perspective view, partly broken away, of a bit being inserted into the sleeve-in-sleeve of the folding knife and interchangeable bit screwdriver of the invention.

FIG. 12 is a perspective view of a magnetic retainer version of the folding knife and interchangeable bit screwdriver of the invention.

FIG. 13 is a perspective fragmentary view, partly broken away, of the magnetic retainer version of the folding knife and interchangeable bit screwdriver of the invention.

DESCRIPTION OF THE PREFERRED EMBODIMENT

Figure 1:
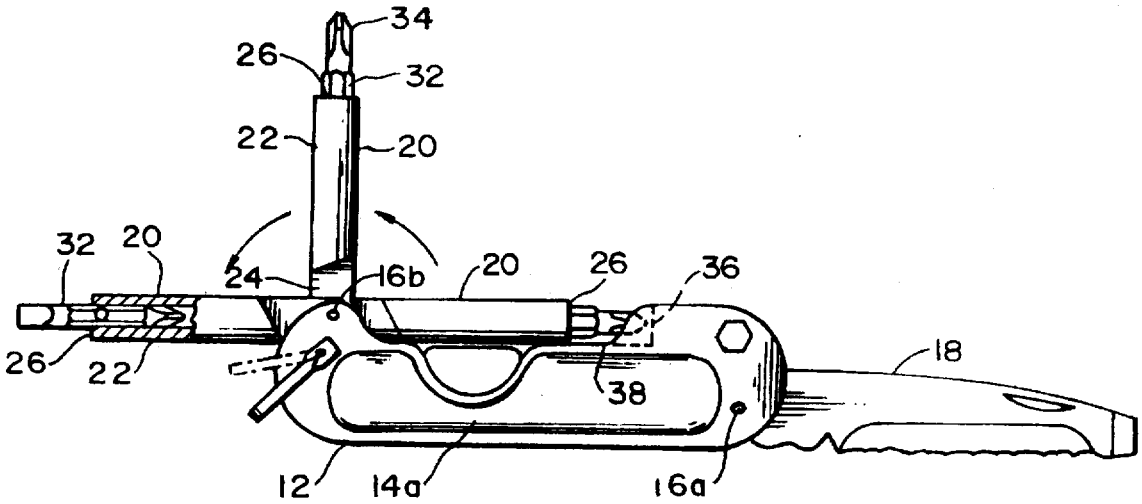
FIG. 1 is a plan view of the folding knife and interchangeable bit screwdriver of the invention showing the sleeve and bit in closed and operative positions and a knife blade in operative position.
Figure 2:
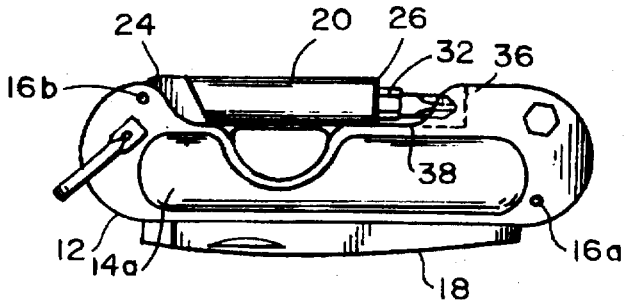
FIG. 2 is a plan view of the folding knife and interchangeable bit screwdriver of the invention as shown in FIG. 1 in closed position.
Figure 3:
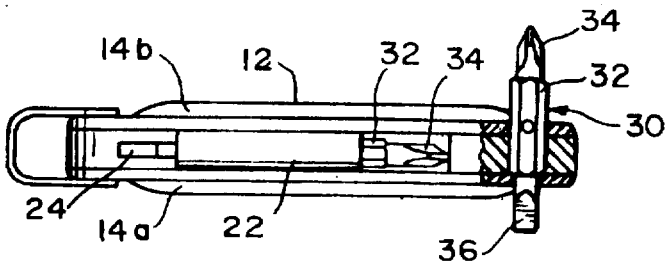
FIG. 3 is a top view of the folding knife and interchangeable bit screwdriver of the invention showing a screwdriver bit in offset position.
Figure 4:
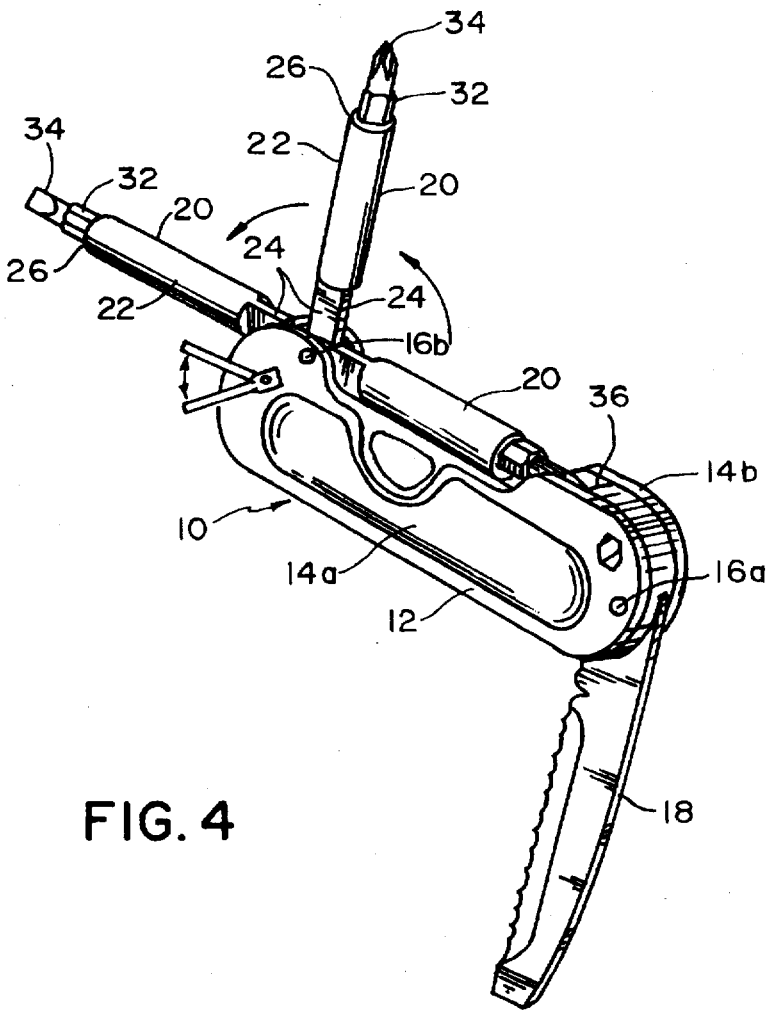
FIG. 4 is a perspective view of the folding knife and interchangeable bit screwdriver of the invention showing the sleeve and bit in closed and operative positions and a knife blade in partially open position.
Figure 5:
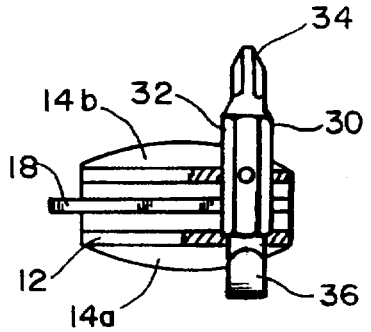
FIG. 5 is an end view of the folding knife and interchangeable bit screwdriver of the invention as shown in FIG. 3.

With reference to the drawing, the folding knife and interchangeable bit screwdriver of the invention 10 comprises handle means 12 having a pair of spaced similarly shaped side bolsters **14*a* and 14*b*. A plurality of hinge pins 16*a* and 16*b* are provided, each traversing between side bolsters 14*a* and 14*b* and perpendicular to the longitudinal axis of handle means 12. In the preferred embodiment, at least one hinge pin is provided at each end of handle means 12. Rotatably attached to one hinge pin 16*a* is a knife blade 18 which swivels about hinge pin 16*a* from a closed position partly or entirely recessed in handle means 12, as shown on FIG. 2, to a partly open position as shown in FIG. 4, to a fully open and operative position as shown in FIG. 1**.

Rotatably attached to hinge pin **16*b* is sleeve means 20, comprising hollow tube means 22 having a hinged end 24 and an open end 26 opposite hinged end 24. The interior of hollow tube means 22** is hexagonal in cross-section.

Reversible screwdriver bit 30 comprises a central shoulder section 32 which is non-circular in cross-section, preferably hexagonal, and is adapted to slidably fit within hollow tube means 22. Each end of reversible bit 30 has a screwdriver drive. As shown in the drawing, reversible bit 30 has a Phillips drive end 34 and a crosscut drive end 36, but any combination of useful screwdriver configurations may be used. The screwdriver ends are smaller in cross-section than the cross-section of shoulder section 32 to permit insertion into hollow tube means 22. Reversible bit 30 may be inserted into hollow tube means 22 with either end exposed for use and may be withdrawn and reversed for use of the opposite end. Sleeve means 20 is rotatable about hinge pin **16*b* from an open position, at any angle with respect to the longitudinal axis of handle means 12, or closed wholly or partially within a recess 36 provided in handle means 12** for the purpose.

Figure 6:
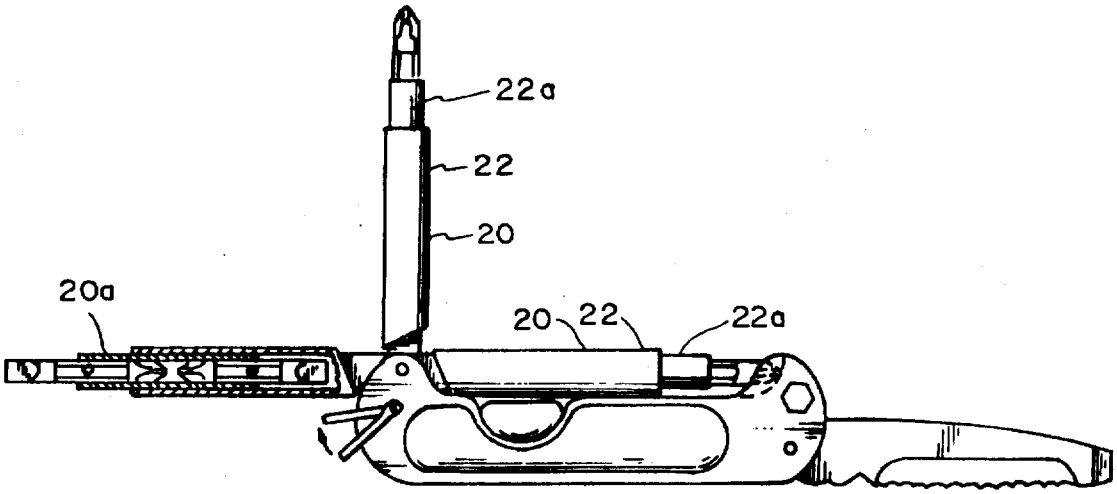
FIG. 6 is a plan view of the folding knife and interchangeable bit screwdriver of the invention showing a sleeve-in-sleeve version of the invention in closed and operative positions and partially broken away to show the internal construction, and a knife blade in operative position.
Figure 7:
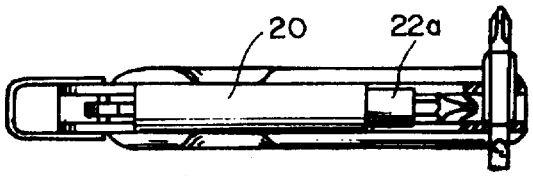
FIG. 7 is a top view of the folding knife and interchangeable bit screwdriver of the invention of FIG. 6, showing the sleeve-in-sleeve and bit in closed position and a bit in offset position.
Figure 8:
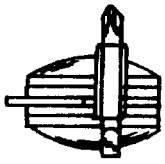
FIG. 8 is an end view of the folding knife and interchangeable bit screwdriver of the invention shown in FIG. 7.

Retaining means are provided on each reversible bit 30 to removably retain each bit in hollow tube means 30. In the preferred embodiment, such retaining means comprise a spring-loaded ball 35. Means such as spring-loaded detents may be provided to retain hollow tube means 30 in closed, 90° open and 180° open positions as shown in FIGS. 1, 4 and 6. Reversible bits 30 may also be referred to as interchangeable bit means.

Side bolsters 14*a* and 14*b* are provided with a central depression 38 adapted to receive the users fingers when using knife 18 to help prevent the fingers from sliding onto the knife blade. With appropriate location of hinge pin 16*b* adjacent depression 38, sleeve means 20 may close into depression 38 as well as into recess 36 when closed. Hingedly opening sleeve means 20 exposes depression 38 for use.

With one reversible bit 30, a 2-in-1 folding screwdriver means is provided. The invention also provides a 4-in-1 folding screwdriver means as shown in FIGS. 6–11. Sleeve means 20 is provided with an inner sleeve 22*a* which is slidably secured within hollow tube 22. Means are provided to prevent inner sleeve 22*a* from rotating relative to hollow tube 22, such as by having the exterior of inner sleeve 22*a* hexagonal in cross-section to mate with the hexagonal interior of hollow tube 22. Inner sleeve 22*a* itself has a hexagonal interior adapted to receive and matingly engage shoulder section 32 of reversible bit 30 such that there is no relative rotational motion therebetween. Inner sleeve 22*a* is sufficiently long to receive two reversible bits 30 at the same time, yielding four bit ends for use by reversing either bit in inner sleeve 22*a*, or by reversing inner sleeve 22*a* in hollow tube 22.

What is claimed is:

1. A combination folding tool and screwdriver, comprising:

handle means;

folding tool means, said folding tool means comprising at least one tool hingedly secured to said handle means;

interchangeable bit screwdriver means, said interchangeable bit screwdriver means being secured to said handles means;

said interchangeable bit screwdriver means comprises interchangeable bits and sleeve means;

said sleeve means being hinged to said handle means and comprising receiving means adapted to receive said interchangeable bits and to prevent relative rotation therebetween;

said sleeve means comprises retaining means to removably retain said interchangeable bits in said sleeve means, and said sleeve means additionally comprises inner sleeve means and outer tube means, said inner sleeve means being removably secured in said outer tube meansagainst rotational movement therebetween, said interchangeable bits being removably secured in said inner sleeve means against rotational movement therebetween, whereby said sleeve means removably retains said interchangeable bits in hinged relationship to said handle means.

2. A combination folding tool and screwdriver in accordance with claim 1, wherein said folding tool and screwdriver including at least one knife blade.

3. A combination folding tool and screwdriver in accordance with claim 1, wherein said interchangeable bits are reversible in said sleeve means.

4. A combination folding tool and screwdriver in accordance with claim 1, including cross-hole means comprising at least one non-circular hold extending substantially perpendicularly to said handle means.

5. A combination folding tool and screwdriver, comprising:

handle means;

folding tool means, said folding tool means comprising at least one tool hingedly secured to said handle means;

interchangeable bit screwdriver means, said interchangeable bit screwdriver means being secured to said handle means;

said interchangeable bit screwdriver means comprises interchangeable bits and sleeve means;

said sleeve means being hinged to said handle means and comprising receiving means adapted to receive said interchangeable bits and to prevent relative rotation therebetween;

said sleeve means comprises retaining means to removably retain said interchangeable bits in said sleeve means, and said sleeve means additionally comprises inner sleeve means and outer tube means, said inner sleeve means being removably secured in said outer tube means against rotational movement therebetween, said interchangeable bits being removably secured in said inner sleeve means against rotational movement therebetween, and said inner sleeve means being hexagonal in cross-section to mate with said shoulders, whereby said sleeve means removably retains said interchangeable bits in hinged relationship to said handle means.

6. A combination folding tool and screwdriver in accordance with claim 5, wherein said folding tool and screwdriver including at least one knife blade.

7. A combination folding tool and screwdriver in accordance with claim 5, wherein said interchangeable bits are reversible in said sleeve means.

* * * * *